US005779745A

United States Patent [19]

Kilström

[11] Patent Number: 5,779,745

[45] Date of Patent: Jul. 14, 1998

[54] ADAPTOR FOR A VACUUM CLEANER

[75] Inventor: Lars Kilström, Täby, Sweden

[73] Assignee: Aktiebolaget Electrolux, Stockholm, Sweden

[21] Appl. No.: 766,415

[22] Filed: Dec. 12, 1996

[30] Foreign Application Priority Data

Dec. 28, 1995 [SE] Sweden ..... 9504682

[51] Int. Cl.[6] ..... B01D 50/00; A47L 9/16

[52] U.S. Cl. ..... 55/337; 15/350; 15/353; 55/DIG. 3

[58] Field of Search ..... 55/DIG. 3, 337, 55/319, 320, 322, 325, 326, 327, 328, 332; 15/353, 350, 347

[56] References Cited

U.S. PATENT DOCUMENTS

| | | | |
|---|---|---|---|
| 963,139 | 7/1910 | Griffiths | 55/325 |
| 1,127,896 | 2/1915 | Keller | 55/325 |
| 3,177,635 | 4/1965 | Cawl et al. | 55/337 |
| 3,320,727 | 5/1967 | Farley et al. | 55/337 |
| 3,552,100 | 1/1971 | Ekenberg | 55/337 |
| 3,877,902 | 4/1975 | Eriksson et al. | 55/DIG. 3 |
| 4,172,710 | 10/1979 | Van Der Molen | 55/DIG. 3 |
| 4,718,924 | 1/1988 | DeMarco | 55/DIG. 3 |
| 4,731,101 | 3/1988 | Kanda | 55/DIG. 3 |
| 5,135,552 | 8/1992 | Weistra | 55/337 |
| 5,230,722 | 7/1993 | Yonkers | 55/337 |
| 5,254,147 | 10/1993 | Finke | 55/DIG. 3 |

FOREIGN PATENT DOCUMENTS

| | | | |
|---|---|---|---|
| 119307 | 7/1947 | Sweden | 55/DIG. 3 |

*Primary Examiner*—Duane S. Smith
*Attorney, Agent, or Firm*—Pearne, Gordon, McCoy and Granger LLP

[57] ABSTRACT

An adaptor for a vacuum cleaner having a vacuum source (21) and an inlet tube (18) communicating with a nozzle opening (11) and ending in a chamber (15) which has an opening closed by a cover (17). A dust container (16) is normally placed in the chamber and is connected to the inlet tube. The adaptor is a separate unit (26) which, when the dust container (16) and cover (17) have been removed, can be fixed to the vacuum cleaner. The adaptor includes a cyclone separator (32) having an inlet side which is connected to the inlet tube (18) and an outlet side communicating with the inlet side of the vacuum source (21).

19 Claims, 3 Drawing Sheets

ADAPTOR FOR A VACUUM CLEANER

BACKGROUND OF THE INVENTION

The present invention relates to an adaptor for a vacuum cleaner wherein the vacuum cleaner has a vacuum source and an inlet tube or the like communicating with a nozzle opening and ending in a chamber which has an opening closed by a cover, and wherein a dust container is disposed in the chamber and normally connected to the inlet tube.

Vacuum cleaners of the type mentioned above are known in the art, and can generally be classified as either upright vacuum cleaners or as canister vacuum cleaners.

A vacuum cleaner of the upright-type usually comprises a lower wheel-supported part including a brush roll that is placed in the nozzle opening, and driving means for the brush. The lower part is, via a link arrangement, connected with an upper part having a chamber for the dust container. An upper portion of the upper part is shaped as a handle by means of which the vacuum cleaner is moved on the surface. The vacuum source, which usually is a fan driven by an electric motor, is, for upright vacuum cleaners, placed in either the upper or the lower part.

Vacuum cleaners of the canister-type comprise a motor-fan unit and a housing surrounding a chamber in which the dust bag is inserted. The end of the inlet tube in the chamber is connected, via a hose, a tube handle, and a tube shaft, to the inlet opening of the nozzle, which is separated from the housing.

It is also previously known to integrate cyclone separators into conventional vacuum cleaners of the canister-type, see for instance EP-A-489468. However, this arrangement has the disadvantage that the size of the vacuum cleaner increases since space for both the conventional filter container and the material separated by the cyclone separator is necessary.

In recent years, vacuum cleaners of the upright-type which are provided with cyclone separators have been developed, see for instance EP-B-489565. In these vacuum cleaners, the upper part is shaped as a cyclone which forms an integrated unit together with the motor. Particles are separated from the air in the cyclone and fall down by gravity into a collecting container from which they are manually removed. Even if there are certain disadvantages with this type of vacuum cleaner, such as large flow resistance causing an increased demand of power from the electric motor of the vacuum source in order to obtain the same suction effect for the nozzle part as in a conventional vacuum cleaner, unhygienic emptying of the dust container, and high production costs, a cyclone separator can, for certain purposes, provide an advantage. Namely, in circumstances when there is a desire to remove or vacuum-up large volumes of easily separable material, such as coarse sand, and where the consumption of dust containers in a conventional vacuum cleaner would be large.

SUMMARY OF THE INVENTION

The purpose of the present invention is to achieve an accessory for a conventional vacuum cleaner by means of which the vacuum cleaner in a simple way can be converted to a cyclone vacuum cleaner in order to make it possible to choose a suitable or desired method for picking up the material from the surface.

In accordance with the present invention, an adaptor for a vacuum cleaner is adapted to replace a conventional cover and filter bag, and includes a coarse separator and a cyclone separator which are serially connected. The coarse separator is provided in a first container and is connected, via a first channel, to an inlet tube, which is otherwise normally connected to a filter bag. Large or heavy particles are separated from the air stream in the coarse separator, and are deposited at the bottom of the first container. A first channel connects the first container with the cyclone separator.

In further accordance with the present invention, a second channel has an inlet disposed at an upper part of the first container, and fluidly connects the first container with the cyclone separator. The cyclone separator has a frustoconical body which is open at a bottom, narrow end to permit particles to fall onto a bottom wall of a second container. A cylindrical tube is located in the cyclone separator and conducts generally particle-free air out of the cyclone separator.

BRIEF DESCRIPTION OF THE DRAWINGS

These and further features of the present invention will be apparent with reference to the following description and drawings wherein.

DETAILED DESCRIPTION OF THE PREFERRED EMBODIMENT

Figure 1:
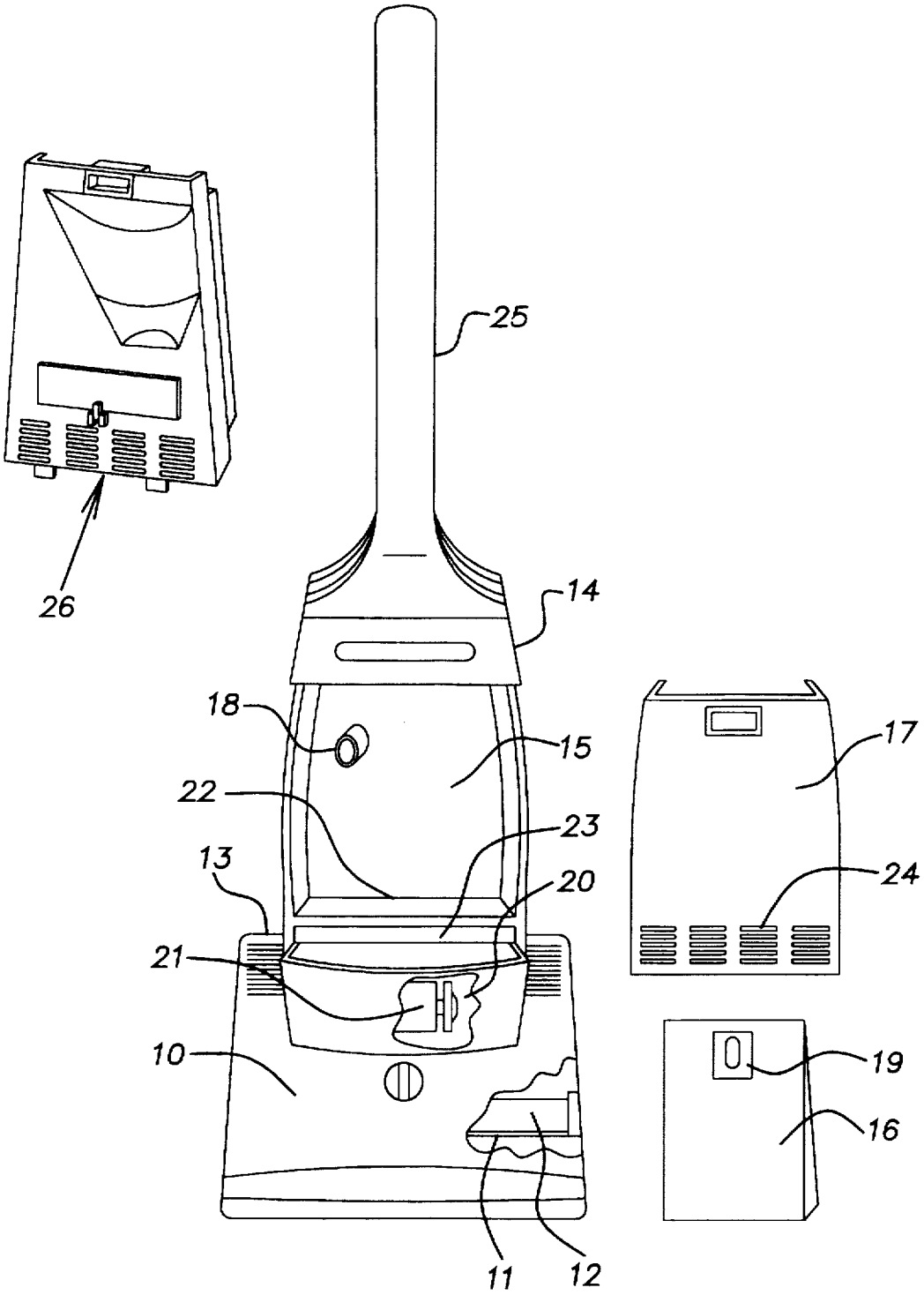
FIG. 1 is a partly broken exploded perspective view of the front side of a vacuum cleaner showing a dust container, a cover for the chamber that contains the dust container, and an accessory according to the invention.

As shown in FIG. 1, the vacuum cleaner comprises a lower part 10 having a nozzle opening 11 in which a brush roll 12 is rotatably mounted and driven, for instance by means of an electric motor (not shown). The lower part 10 is supported by rear wheels 13 and front wheels (not shown).

The lower part 10 is, by means of a link mechanism, connected to an upper part 14. The upper part 14 comprises a chamber 15 that normally encloses a dust container 16 and that has an opening closed by a cover 17. The nozzle opening 11 in the lower part 10 communicates with an inlet tube 18 to which a collar 19 of the dust container can be connected.

The lower portion of the upper part 14 is shaped as a motor housing 20 in which a motor-fan unit 21 is disposed. The inlet side of the fan unit communicates with the chamber 15 via an opening 22 whereas the outlet side of the fan unit is connected to an outlet part 23 whose opening is normally covered by the lower portion of the cover 17. The cover lower portion has several diffusor openings 24 through which exhaust air flows to atmosphere. The upper portion 25 of the upper part 14 is shaped as a shaft with a handle by means of which the vacuum cleaner is moved on the surface.

Figure 2:
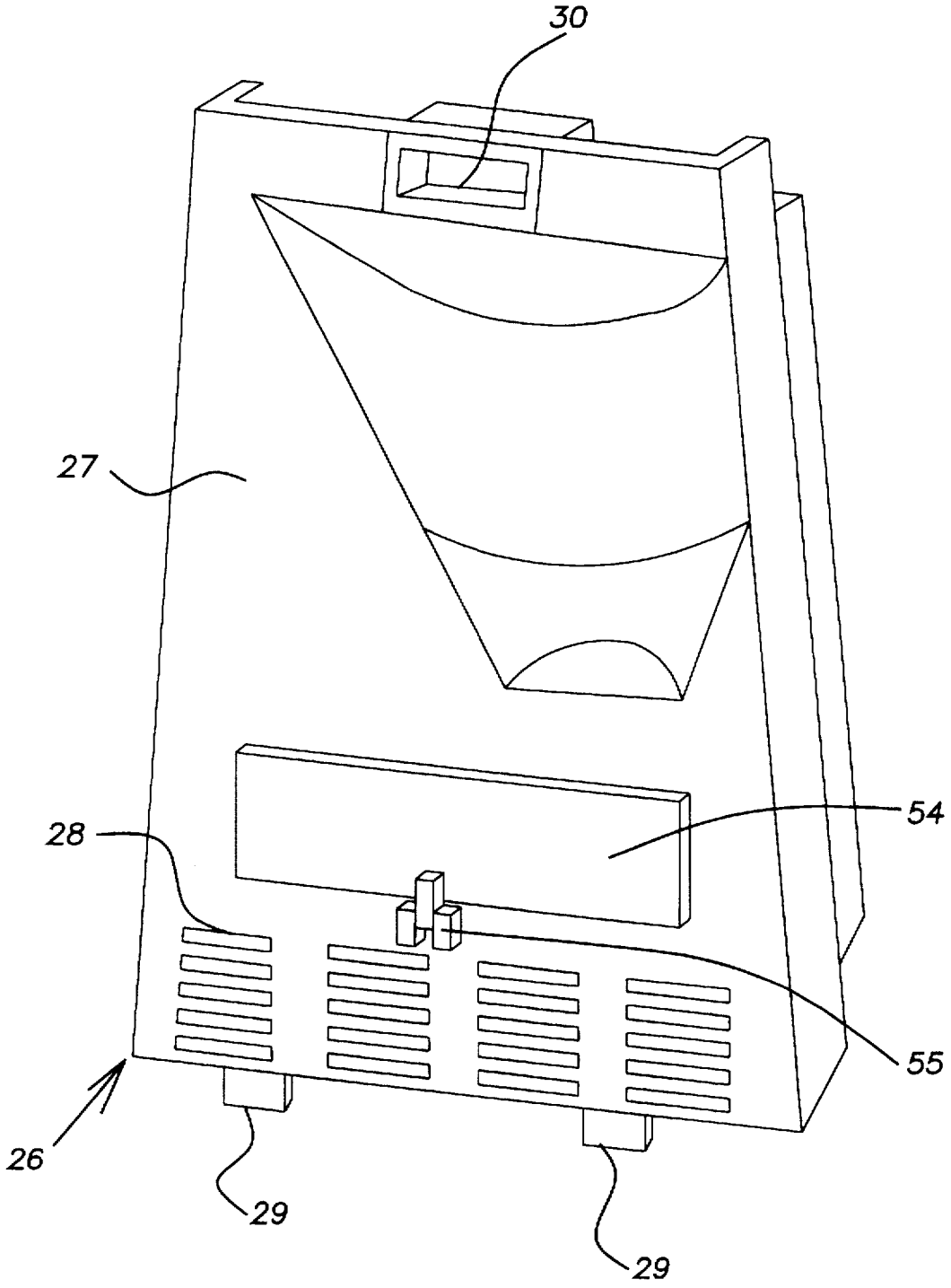
FIG. 2 is a perspective view of the front side of the accessory.

The vacuum cleaner includes an adaptor 26. The adaptor 26 is a separate unit with a front wall 27 that replaces the cover 17 when the adaptor 26 is fixed to the vacuum cleaner. Similar to the cover 17, the front wall 27 has, at its lower part, several diffusor openings 28 through which the air escapes to atmosphere. The front wall 27 also has hooks 29 and a locking mechanism 30 by means of which the adaptor is fixed to the vacuum cleaner (FIG. 2).

Figure 3:
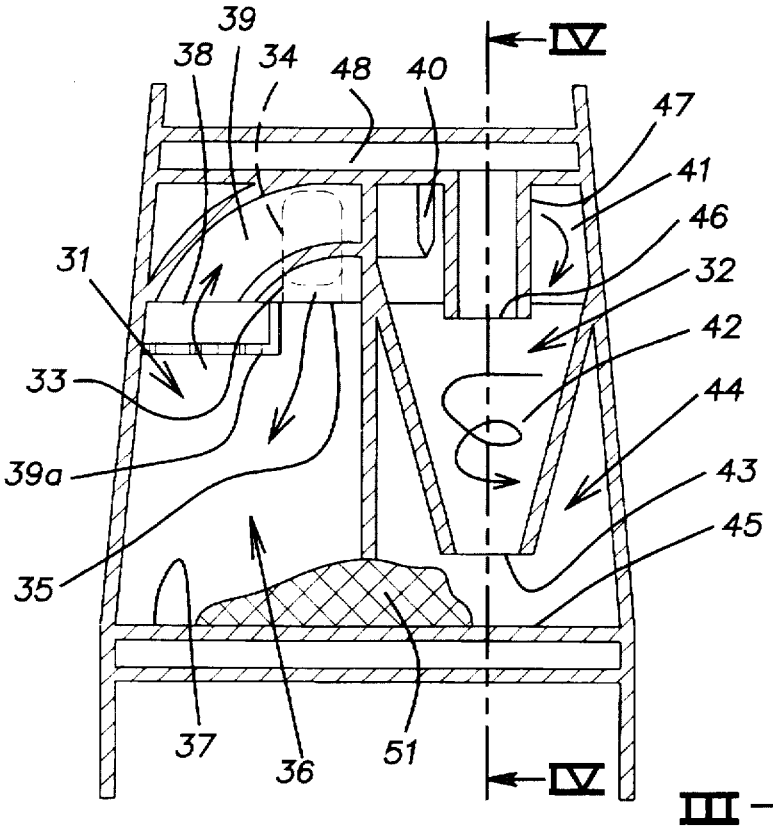
FIG. 3 is a section through the accessory on the line III—III in FIG. 4.
Figure 4:
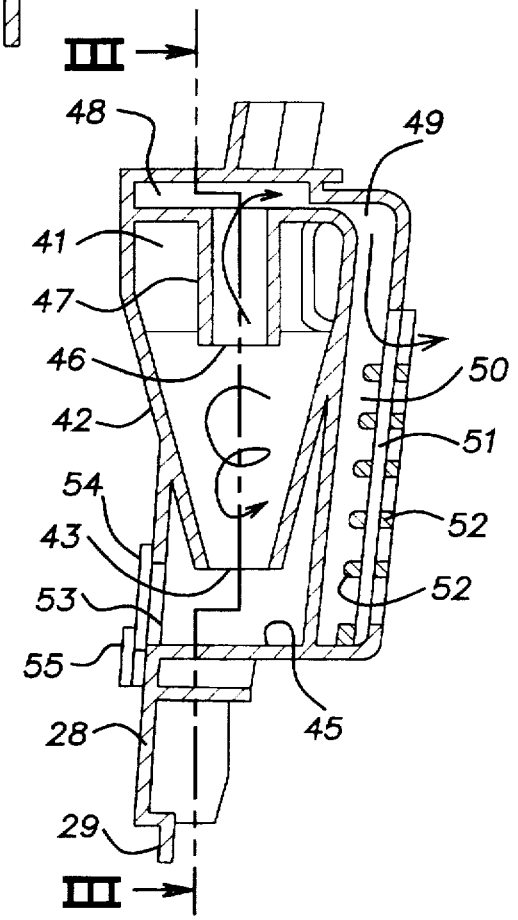
FIG. 4 is a section on the line IV—IV in FIG. 3.

With reference to FIGS. 3 and 4, the adaptor 26 includes a coarse separator 31 and a cyclone separator 32. When the adaptor 26 is arranged on the vacuum cleaner, the coarse separator 31 is connected to the inlet tube 18 via a first channel or passageway 33 having an inlet opening 34. An end 35 of the first channel 33 is arranged at the upper portion of a first container 36. The first container 36 has a bottom 37 on which the separated dirt is collected. At an upper part of the first container 36 there is an inlet 38 to a second channel or passageway 39. In front of the inlet 38 there is a grating 39*a* preventing larger particles from entering the inlet.

The second channel 39 has an outlet end 40 which is placed at the periphery of a mainly cylinder-shaped part 41 of the cyclone separator 32 so that the air flows tangentially into the cylinder-shaped part 41. The cylinder-shaped part 41 continues downwardly into a truncated hollow cone 42 which is placed upside down and which, at its lower part, has an opening 43 through which the material separated by the cyclone can escape or fall into a second container 44. Separated material collects on the bottom 45 of the second container 44.

The cyclone separator 32 also has a central outlet opening 46 which is at a lower end of a cylinder-shaped part 47 that extends down into the cyclone. The outlet opening 46 is generally co-axial with the opening 43. The cylinder-shaped part 47, via a space 48 and a passage 49, continues into a parallelepipedic space 50 forming a third channel or passageway for the air. One of the walls surrounding or defining the space 50 has an opening that is provided with a filter 51 facing the chamber 15. The filter 51 is fixed to the adaptor 26 by means of gratings 52 placed on opposite sides of the filter 51.

A lower part of each container 36 and 44 has an opening 53 covered by a common lid 54. The lid 54 is kept in position by means of a locking mechanism 55 on the adaptor 26 and can be opened to empty the two containers.

The device operates in the following manner. Under normal operating conditions, the collar 19 of the dust container 16 is connected to the inlet tube 18 so that the air flows through the dust container. The opening of the chamber 15 and the outlet part 23 is closed by the cover 17. Air is drawn from the surface through the nozzle opening 11 and the air flows through the inlet tube 18 and through the dust container 16 where the dirt particles are separated from the air flow. The air then flows through the chamber 15 and the opening 22 to the fan unit 21 from which it escapes to atmosphere via the outlet part 23 and the openings 24 in the cover 17. In order to replace the dust container 16, the cover 17 is removed which means that the dust container 16 becomes accessible and can be removed from the inlet tube 18.

When the adaptor 26 is to be used, the cover 17 and the dust container 16 are removed. Then the adaptor 26 is inserted into the chamber 15 so that the inlet tube 18 engages the inlet opening 34 while the adaptor front wall 27 closes the chamber 15 and the outlet part 23. When the fan unit is started, the air will flow from the nozzle opening 11, via the inlet tube 18 and the first channel 33, into the coarse separator 31 in which heavier particles, by means of gravity, are separated from the air flow and are collected at the bottom of the container 36.

The air then flows through the inlet 38 and the second channel 39 to the cylindrical part 41 of the cyclone separator 32. Particles, by means of centrifugal forces, are thrown outwardly towards the cylindrical surface and simultaneously fall down through the conical part 42 and collect at the bottom wall 45 of the container 44. The air in the central part of the separator which is cleaned from particles then flows through the outlet opening 46, the cylindrical part 47, the space 48, the passage 49, the space 50 and the filter 51 into the chamber 15. From the chamber 15 air flows, in the way described above, through the opening 22 to the fan unit 21 and further to atmosphere via the outlet part 23 and the openings 28.

In order to empty the two containers 36 and 44, the adaptor 26 is removed from the vacuum cleaner. Thereafter, the lid 54 is opened so that particles can be shaken out of the containers 36, 44.

It should be mentioned that the adaptor according to the present invention can also be used on canister-type vacuum cleaners. It is, of course, also possible to use the adaptor according to the present invention with vacuum cleaners wherein the fan unit is placed before the chamber 15 as seen in the direction of air flow, which is often the case with upright vacuum cleaners where the unit is arranged close to the nozzle opening in the lower part 10 of the vacuum cleaner. The adaptor can also be used for so called wet/dry cleaners wherein dust and dirty water are alternatively collected.

From the foregoing, it should be clear that the present invention is capable of numerous modifications, rearrangements of parts, and reconfiguration without departing from the scope and spirit of the present invention. Therefore, the present invention is not limited to the preferred and illustrated embodiment, but rather will cover and include all device which fall within the purview of the claims appended hereto.

What is claimed is:

1. Adaptor for a vacuum cleaner, said vacuum cleaner comprising a vacuum source (21) and an inlet tube (18) communicating with a nozzle opening (11) and ending in a chamber (15) which has an opening closed by a cover (17), a dust container (16) disposed in the chamber and normally connected to the inlet tube, wherein the adaptor is a separate unit (26) which, when the dust container (16) and cover (17) have been removed from the vacuum cleaner, is secured to the vacuum cleaner and disposed within the chamber, said adaptor comprising a cyclone separator (32) having an inlet side connected to the inlet tube (18).

2. Adaptor according to claim 1, further comprising a first container (36) serving as a coarse separator (31) which, via a first channel (33), communicates with said inlet tube (18), an opening (35) of the first channel being placed at an upper part of the first container, said first container, via a second channel (39), communicating with the cyclone separator (32).

3. Adaptor according to claim 2, wherein an inlet opening (38) of the second channel (39) is placed near the upper part of the first container (36).

4. Adaptor according to claim 2, wherein the cyclone separator (32) comprises a cylinder-shaped upper part (41) to which the opening (40) of the second channel (39) is connected so that air flows generally tangentially to the upper part and wherein the upper part is connected to a second container (44) in which the particles being separated by the cyclone separator are collected.

5. Adaptor according to claim 4, wherein the cylinder-shaped upper part (41) continues into a lower part (42) shaped as an upside-down truncated hollow cone, a lower end of the cone forming an opening (43) to the second container (44).

6. Adaptor according to claim 4, wherein the cyclone separator (32) is provided with an outlet opening (46) which, via a third channel (47,48,49,50), communicates with said chamber (15).

7. Adaptor according to claim 6, wherein the outlet opening (46) is mainly coaxial with the cylinder-shaped upper part (41).

8. Adaptor according to claim 6, wherein the third channel is provided with a filter (51) arranged before the chamber (15) as seen in the direction of air flow.

9. Adaptor according to claim 4, wherein the first and second containers (36 and 44 resp) are placed close to each other and wherein each container, at its lower part, is provided with an opening (53), the container opening normally being closed by at least one cover (54).

10. Adaptor according to claim 1, wherein the adaptor is integrally-formed with a cover plate, said cover plate closing the opening of the chamber (15) when the adaptor is secured to the vacuum cleaner.

11. A vacuum cleaner adaptor, comprising a first container (36) serving as a coarse separator (31), and a cyclone separator (32), said first container being adapted to communicate with an inlet tube via a first channel (33), said first container communicating with said cyclone separator via a second channel (39).

12. A vacuum cleaner adaptor according to claim 11, wherein an opening of said first channel is at an upper part of the first container and an inlet opening of said second channel is near the upper part of said first container.

13. Adaptor according to claim 12, wherein the cyclone separator (32) comprises a cylinder-shaped upper part (41) to which the opening (40) of the second channel (39) is connected so that airs flows generally tangentially to the cylinder-shaped upper part and wherein the cylinder-shaped upper part is connected to a second container (44) in which the particles being separated by the cyclone separator are collected.

14. Adaptor according to claim 13, wherein the cylinder-shaped upper part (41) continues into a lower part (42) shaped as an upside-down truncated hollow cone, a lower end of the cone forming an opening (43) to the second container (44).

15. Adaptor according to claim 14, wherein the cyclone separator (32) is provided with an outlet opening (46) through which, and via a third channel (47,48,49,50), air exits the adaptor.

16. Adaptor according to claim 15, wherein the outlet opening (46) is mainly coaxial with the cylinder-shaped upper part (41).

17. Adaptor according to claim 16, wherein the third channel is provided with a filter (51).

18. Adaptor according to claim 17, wherein the first and second containers (36 and 44 resp) are placed close to each other and wherein each container, at its lower part, is provided with an opening (53), the container opening normally being closed by at least one cover (54).

19. Adaptor according to claim 18, wherein the adaptor integrally includes a cover plate.

* * * * *